United States Patent [19]

Fankhanel et al.

[11] 4,302,177

[45] Nov. 24, 1981

[54] FUEL CONVERSION APPARATUS AND METHOD

[75] Inventors: Martin O. Fankhanel; Alfred K. Roosov, both of Houston, Tex.

[73] Assignee: The M. W. Kellogg Company, Houston, Tex.

[21] Appl. No.: 912,627

[22] Filed: Jun. 5, 1978

Related U.S. Application Data

[72] Continuation-in-part of Ser. No. 778,518, Mar. 17, 1977, abandoned which is a Continuation-in-part of Ser. No. 670,808, Mar. 26, 1976, abandoned.

[51] Int. Cl.[3] ..... F23D 11/44; F23L 15/00

[52] U.S. Cl. ..... 431/11; 431/211; 431/212; 431/163; 48/197 R

[58] Field of Search ..... 431/3, 4, 11, 163, 211, 431/212; 122/488-492; 60/39.53, 39.59; 252/373; 422/182, 183, 198, 298; 48/197 R, 213, 214 R

[56] References Cited

U.S. PATENT DOCUMENTS

| | | | |
|---|---|---|---|
| 977,208 | 11/1910 | Maxim | 431/4 |
| 1,097,066 | 5/1914 | Turner | 431/212 |
| 1,420,957 | 6/1922 | Bishop | 431/163 |
| 1,520,624 | 12/1924 | Wiederwax | 431/4 |
| 1,619,859 | 3/1927 | Gillman | 431/163 |
| 2,989,118 | 6/1961 | Cleverdon | 431/11 |
| 3,048,131 | 8/1962 | Hardgrove | 431/11 X |
| 3,363,993 | 1/1968 | Cambell | 422/182x |
| 4,025,282 | 5/1977 | Reed et al. | 431/3 |
| 4,089,805 | 5/1978 | Gambrell | 431/11x |

*Primary Examiner*—Larry Jones

*Attorney, Agent, or Firm*—K. S. Myers; C. W. Crady

[57] ABSTRACT

Apparatus and method are described for the vaporization of liquid fuel oils to produce a gaseous mixture suitable for burning in a burner normally designed for operation utilizing natural gas.

7 Claims, 3 Drawing Figures

NAT. GAS
STEAM
#2 FUEL OIL
FEED PREHEAT EXCHANGER 226
OIL VAPORIZER
BURNERS
SEPARATOR
200
202
204
206
210
212
214
218
220
222
224
228
230
232
236
238
240
242
244
246
248
250
252
254
256
258
260
262
264
266
268
270
272
274
276
278
280
282
284
286

FUEL CONVERSION APPARATUS AND METHOD

CROSS REFERENCE TO RELATED APPLICATIONS

This is a continuation-in-part of application Ser. No. 778,518 filed Mar. 17, 1977, now abandoned, which in turn is a continuation-in-part of application Ser. No. 670,808 filed Mar. 26, 1976, now abandoned.

BACKGROUND OF THE INVENTION

This invention relates to the utilization of liquid fuel oils, particularly Fuel Oil No. 2 through Fuel Oil No. 4, as an alternate source of fuel in normally gas fired equipment, such as boilers, gas turbines, various industrial furnaces and particularly for hydrocarbon steam reformers. With increasing demands placed upon natural gas reserves by use of natural gas in the production of petrochemicals and petrochemical products, a scarcity of natural gas has been created such that it is necessary to find sources of alternate fuels for gas fired equipment. Of course, it is possible to remove burners designed for natural gas service and replace them with burners designed for burning fuel oil but such is not always economic or advantageous to the operation of equipment where natural gas may be intermittently available for use as a fuel. This is particularly true with respect to hydrocarbon steam reforming furnaces, as described, for example, in U.S. Pat. Nos. 3,257,172; 3,672,847 and 3,768,980, where many such burners are in operation and a conversion to fuel oil service would require days of down time with great loss of productivity.

While it has previously been disclosed, in U.S. Pat. No. 3,393,964 for example, to atomize liquid hydrocarbons in the burner itself with a normally gaseous fuel, such operation would require the replacement of all existing natural gas burners with a specialized burner and, therefore, is impractical. U.S. Pat. No. 3,291,191 describes the broad concept of vaporizing a normally liquid fuel to make it interchangeable with natural gas in the operation of a natural gas burner. It has previously been known to vaporize liquid fuel by heating. Such heating, however, results in heavy residue and consequent formation of coke requiring frequent shut downs for cleaning, and thus is generally unacceptable.

Other methods have been described wherein a portion of the fuel oil is burned with the gaseous products used to vaporize additional fuel oil for burning in a gas fired burner, as described in U.S. Pat. No. 1,987,401. U.S. Pat. No. 3,480,416 describes a method of preparing a gaseous fuel by cracking a portion of a liquid fuel and conjointly heating water to form a gas stream for further use either as a feed for flame cracking or for fuel. Again, there are many consequent disadvantages to such a method. Also, previously, naphthas and light petroleum distillates have been vaporized to replace natural gas as fuel but the prior art does not describe such a system for use of such heavier fuel oils.

U.S. Pat. No. 4,089,805 describes a method for vaporizing 25 to 75 percent by weight of a liquid fuel oil thereby producing a gasiform hydrocarbon fuel and a liquid residue, separating the gasiform hydrocarbon from the liquid residue, superheating the gasiform fuel and burning the gasiform fuel in a gasiform burner.

According to the present invention, it is an object to provide a system whereby fuel oil, such as No. 2 through No. 4 and equivalent, can be essentially fully vaporized (e.g. 99+ percent) to form a gaseous product suitable for use interchangeably, and intermittently, with natural gas in a burner designed for natural gas combustion. It is also an object of this invention to provide apparatus and a method whereby fuel oils, such as Fuel Oil No. 2 through Fuel Oil No. 4 can be used as an alternate fuel for gas without significant coking in the furnace or equipment utilized for vaporizing the oil.

SUMMARY OF THE INVENTION

The present invention is directed to a system and method for vaporizing liquid fuel oils for use, either permanently or intermittently, in burners designed normally for operation with natural gas as the fuel. Fuel oil, preferably a No. 2 Fuel Oil, is mixed with a carrier gas, as hereinafter defined, and the mixture vaporized in a suitable heater to vaporize substantially all the fuel oil such that the gaseous mixture can be burned in a burner designed for normal operation with natural gas as the fuel.

DESCRIPTION OF THE PREFERRED EMBODIMENTS

The practice of this invention is particularly adapted to the use of fuel oils, such as Fuel Oil No. 2 through Fuel Oil No. 4 and other oils having similar characteristics as an alternate fuel for burners normally designed for operation using natural gas. Since many hydrocarbon processing plants require large quantities of natural gas for use as fuel and such gas in becoming in short supply it has been necessary to provide for the operation of many processing units with the more available liquid fuels. The composition and boiling ranges of Fuel Oil No. 2, Fuel Oil No. 3 and Fuel Oil No. 4 are well known (they are specifically described in the *Annual Book of ASTM Standards,* 1975 Edition, pages 217 through 222, as designated standard D-396-75, "Standard Specification for Fuel Oils" as well as American National Standard 2-11.203, hereby incorporated by reference) and these oils are often used to fire furnaces designed for such use but have heretofore not been used as fuel for hydrocarbon processing units designed for natural gas operation without significant changes in equipment. It is well-known that the heavier grades of fuel oil contain more undesirable compounds, such as sulphur and ash, and require more heat to vaporize. However, the system herein described is eminently suitable to provide such duty.

In view of emission limitations placed upon processing plants, many tail gas streams are burned in conjunction with natural gas, both to take advantage of fuel valves and to render such gases innocuous. It is to be understood that when the term "burner designed for natural gas," or equivalent, is used, it includes a burner which uses natural gas and such combustible tail gases as a fuel.

Figure 1:
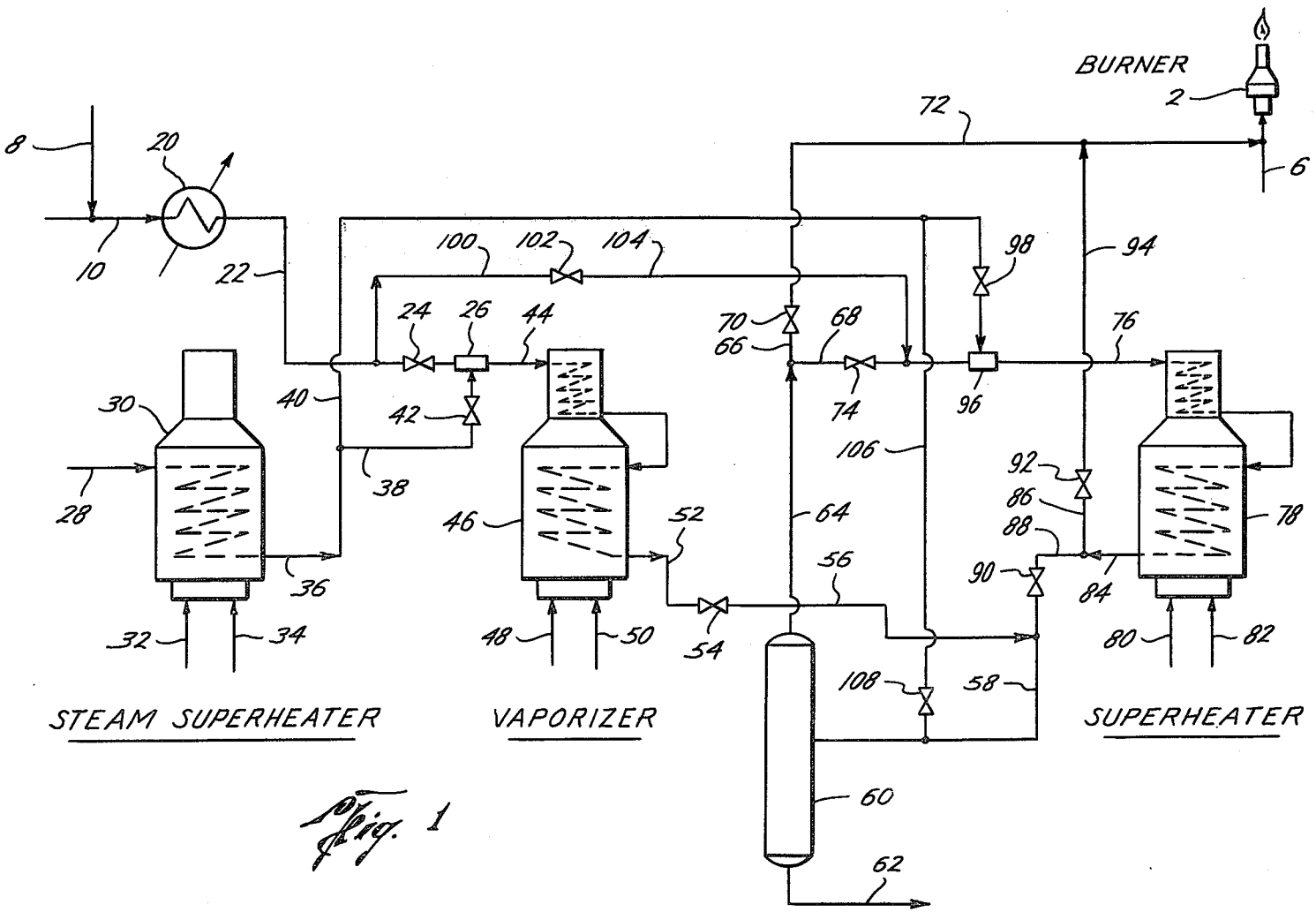
FIG. 1 is a schematic flowsheet, showing an embodiment of this invention with common fittings, valves, flow meters and controls omitted.

Referring to FIG. 1, this schematic flowsheet discloses an embodiment of the present invention. The system of the present invention provides a fuel to a burner 2 which is normally feed by natural gas by line 6. The gaseous mixture supplied to the burner 2 by the system of the present invention will have temperature and pressure conditions suitable for the particular burner design. These temperatures will generally be within the range of from about 550° F. to about 1000° F. Usually, for a hydrocarbon steam reformer, these conditions involve temperatures from about 600° F. to about 800° F. and a pressure of from about 20 to about 65 psig, preferably 25 to 45 psig. Normally, the burner 2 is fired with natural gas, sometimes including a combustible tail gas, which also enters through line 6. When the system of the present invention is connected to the natural gas line 6, this mode of operation allows the quantity of natural gas being burned in the burner 2 to be gradually reduced while the amount of gaseous mixture being burned is gradually increased until vaporized fuel oil provides the sole fuel for the burner 2. As an alternative, the system of the present invention may introduce the natural gas through line 8 into the system to aid in bringing the system on stream to provide sufficient gas flow through the system to prevent operational problems.

For purposes of simplification, FIG. 1 will be described assuming that a No. 2 Fuel Oil is used, it being understood that it is within the scope of this invention to use a fuel oil heavier than No. 2, i.e.. No. 3 or No. 4 Fuel Oil. The vaporization of the fuel oil is carried out in admixture with a carrier gas. In the practice of this invention, while the carrier gas is preferably steam, it is to be understood that combustible tail gases, rich in hydrogen, such as for example, the purge gas from an ammonia plant which generally includes hydrogen, ammonia, nitrogen and argon can either be used alone, if a sufficient quantity is available, or in admixture with steam. Since these tail gases will generally be at an elevated temperature, the latent heat is valuable in aiding in the vaporization of the fuel oil. Tail gases suitable for use will preferably have a molecular weight closely approximating that of steam so that the partial pressure of the vaporized oil is reduced.

Speaking in general terms, natural gas has a heating value of approximately 1000 BTU's per standard cubic foot while a vaporized fuel oil normally has a heating value of from about 2000 to about 5000 BTU/SCF. Thus, it is important to dilute the vaporized fuel oil. In the practice of this invention, the carrier gas, preferably steam, and most preferably superheated steam, is employed, not only as the diluent but to take advantage of the other benefits the carrier gas provides. One such advantage is that the carrier gas, particularly steam, helps to prevent coking, both in the system and in the burner 2. Steam also promotes a cleaner combustion gas when the vaporized fuel oil produced from operation of this invention is burned. Of particular advantage is that the carrier gas reduces the partial pressure of the fuel oil, aiding in the vaporization of the latter. To achieve such advantages, the carrier gas is mixed with the fuel oil in the proportions of about 0.1 to about 1.0 pounds of steam per pound of fuel oil. The upper limits of this ratio will normally be used for the vaporization of the heavier fuel oils with a range of from about 0.1 to about 0.7 normally being used. The optimum ratio can be determined by the degree of vaporization desired and the normal operating conditions of the burner. For No. 2 grade fuel oil, for example, the preferred ratio is from about 0.3 to about 0.5 pounds per pound of fuel oil. Of course, this ratio would be adjusted within the above limits to provide for a proper balance depending upon the grade of fuel oil being used.

No. 2 Fuel Oil enters the system through line 10 and may be heated in exchanger 20 which can be used to consume energy available at the operating plant location. While this heat exchanger 20 is optional, it eases the mixing of the steam with the fuel oil in later operation of the method of this invention. When the heat exchanger 20 is used the No. 2 fuel oil will exit the exchanger at approximately 300° F. through line 22, thence through valve 24 and a mixing means 26 which may be a mixing vessel or nothing more than an ordinary pipeline "Tee." Steam enters the system, preferably at 440° F. and 185 psig, through line 28 into a steam superheater 30 which is operated by burning a fuel in air which enters the superheater 30 through lines 32 and 34, respectively. Of course, the fuel entering through line 32 to be burned may also be Fuel Oil No. 2, such as in being vaporized in the practice of this invention. While the conditions of the carrier gas are flexible, depending upon availability and condition at a particular plant or unit, the steam which exits steam superheater 30 through line 36 will be at about 800° F. and about 180 psig pressure.

As is seen on FIG. 1, line 36 branches into lines 38 and 40. The steam travels through branch 38 and proceeds through valve 42, which is open in normal operation of the system of this invention, and continues into the mixing means 26 to be mixed with the fuel oil. The mixture of steam and liquid fuel oil, in this example, 0.5 pounds per steam per pound of oil, then passes through line 44 to the vaporizer 46 which may burn a fuel in the presence of air entering through lines 48 and 50, respectively. In an embodiment of this invention, the vaporizer 46 is designed to have sufficient heating capacity to not only fully vaporize the fuel oil into a gaseous mixture but also provide some superheat to attain the conditions set for the burner in which the gaseous mixture is to be used. The purpose of this will become apparent from subsequent discussions herein.

Substantially all of the No. 2 Fuel Oil charged under these conditions is vaporized to a gaseous mixture containing the vapors of the fuel oil and steam. Of course, when the heavier fuel oils are used in the system of this invention, there will likely be somewhat more vaporized material but conditions of the carrier gas, proportions thereof and heat in the vaporizer can be adjusted to optimize the conditions. The gaseous mixture leaves the vaporizer 46 through line 52 at conditions of from about 500° F. to about 900° F. and from about 75 to about 130 psig pressure. For Fuel Oil No. 2 the preferred conditions are about 640° F. and 77 psig pressure. The gaseous mixture and any unvaporized fuel oil passes through valve 54, open during normal operation, through line 56 and 58 and thence to separator 60 which can be any appropriate liquid/gas separation device, such as a drum separator. As stated, substantially all liquid is vaporized when No. 2 Fuel Oil, or equivalent, is used but even with the heavier oils about 80 to 98 percent by weight is vaporized and only some liquid will generally exit the vaporizer 46.

The unvaporized fuel oil, if any, exits the separator 60 through line 62 where it can be recovered and used to provide fuel for other use at the plant site, including possibly to fire the vaporizer 46 or superheater 30. The gaseous stream exits the separator 60 through line 64 which branches into lines 66 and 68. Line 66 leads into valve 70, closed during normal operation, and line 72 which acts as a conduit for the vaporized oil to the gas fired burner 2.

Meanwhile, branch 68 proceeds through valve 74, open in normal operation, through line 76 to the vaporized oil superheater 78. The vaporized oil superheater 78 is fired by fuel burned in air entering through lines 80 and 82, respectively. The gaseous mixture, now free of unvaporized fuel oil, is heated in the gas superheater 78 to the conditions at which it will be introduced into the natural gas burner 2; i.e., about 750° F. at about 45 psig, and exits the gas superheater 78 through line 84 which branches into line 86 and 88. Line 88 leads to valve 90, closed in normal operation, which communicates with line 58, as previously described. The heated gaseous mixture is conducted through line 84 to line 86, proceeds through valve 92, open in normal operation, and line 94 which conducts the gaseous mixture to line 72 where it is further transmitted to the natural gas burner 2. The burner 2 represents either a single burner or a plurality thereof and is not, of itself, an element of this invention.

It is preferable in the design and operation of the apparatus of this embodiment using the method of this invention that the oil superheater have the same heat duty as the vaporizer previously described so that either of these two vessels may be used to independently vaporize the fuel oil in the presence of steam to create conditions wherein the gaseous mixture can be used in a burner normally designed to burn natural gas. This allows the vaporizer to be shut down for decoking or maintenance without disturbing the operation of the equipment utilizing the vaporized gaseous mixtures. For equipment, such as hydrocarbon reformers, this is very important since much economy is lost when the system must be shut down. Accordingly, FIG. 1 shows a bypass operation of the system wherein the vaporizer 46 can be taken out of service and the gas superheater 78 be used in its place to act as both the vaporizer and the superheater supplying all the heat necessary to prepare the gaseous mixture for burning. Of course, this is not a preferable way of operating over an extended period of time, but it does allow for maintenance or decoking without forcing the equipment burning the gaseous mixture to shut down. It is also possible, through the alternate piping shown in FIG. 1, to carry the entire heat load through the oil vaporizer and shut down the superheater for decoking, or repair, if necessary.

The superheated steam and fuel oil are mixed in appropriate mixing means 96 when the bypass operation of the system is carried out. In order to bypass the vaporizer 46 branch 40 of line 36 would carry the superheated steam through valve 98, closed in normal operation previously described, to communicate with mixing means 96. The heated fuel oil would bypass the vaporizer 46 by closing valve 24 and diverting the flow in line 22 through line 100, valve 102, closed in normal operation, line 104 to the mixing means 96 in line 76 wherein the fuel oil would be mixed with steam entering through line 98.

During normal operation of the above-described process to provide vaporized No. 2 fuel oil to a steam reformer requiring approximately 600 million BTU's per hour, approximately 0.5 pounds of steam are used per pound of No. 2 fuel oil. The natural gas, entering through line 6 or alternately, for the purpose previously discussed, into line 10 through line 8, used to fire the burner 2 would gradually be replaced by the vaporized fuel oil entering through line 72.

As has been previously stated, the process of this embodiment operates equally well with the oil vaporizer 46 shut down or with the oil superheater 78 shut down. Table 1 illustrates the position of the valves shown in FIG. 1 and described above in these two alternative systems of operation as compared with normal operation, described in detail above.

TABLE I

| Valve | 24 | 42 | 54 | 70 | 74 | 90 | 92 | 98 | 102 |
|---|---|---|---|---|---|---|---|---|---|
| Normal | o | o | o | c | o | c | o | c | c |
| Vaporizer Down | c | c | c | o | c | o | c | o | o |
| Superheater Down | o | o | o | o | c | c | c | c | c |

o - open
c - closed

As can now be readily seen, the embodiment as described above and shown in FIG. 1 offers great flexibility of design and operation with respect to the vaporization of not only Fuel Oil No. 2 but Fuel Oil No. 3 and Fuel Oil No. 4, and substantially equivalent hydrocarbon mixtures, for use in not only hydrocarbon steam reformers utilizing natural gas burners, as previously discussed, but in substantially any equipment wherein such burners are used. When the heavier fuel oils are used, superheated steam is added to the gaseous mixture in line 58 through line 106 by opening valve 108. If vaporization is not complete prior to the addition of steam, substantially complete vaporization is achieved upon addition of the steam. This addition of steam is not required to achieve the full vaporization of No. 2 fuel oil but may nevertheless be done when the distance from the superheater to the burner is such that the burner conditions necessitate such addition.

Figure 2:
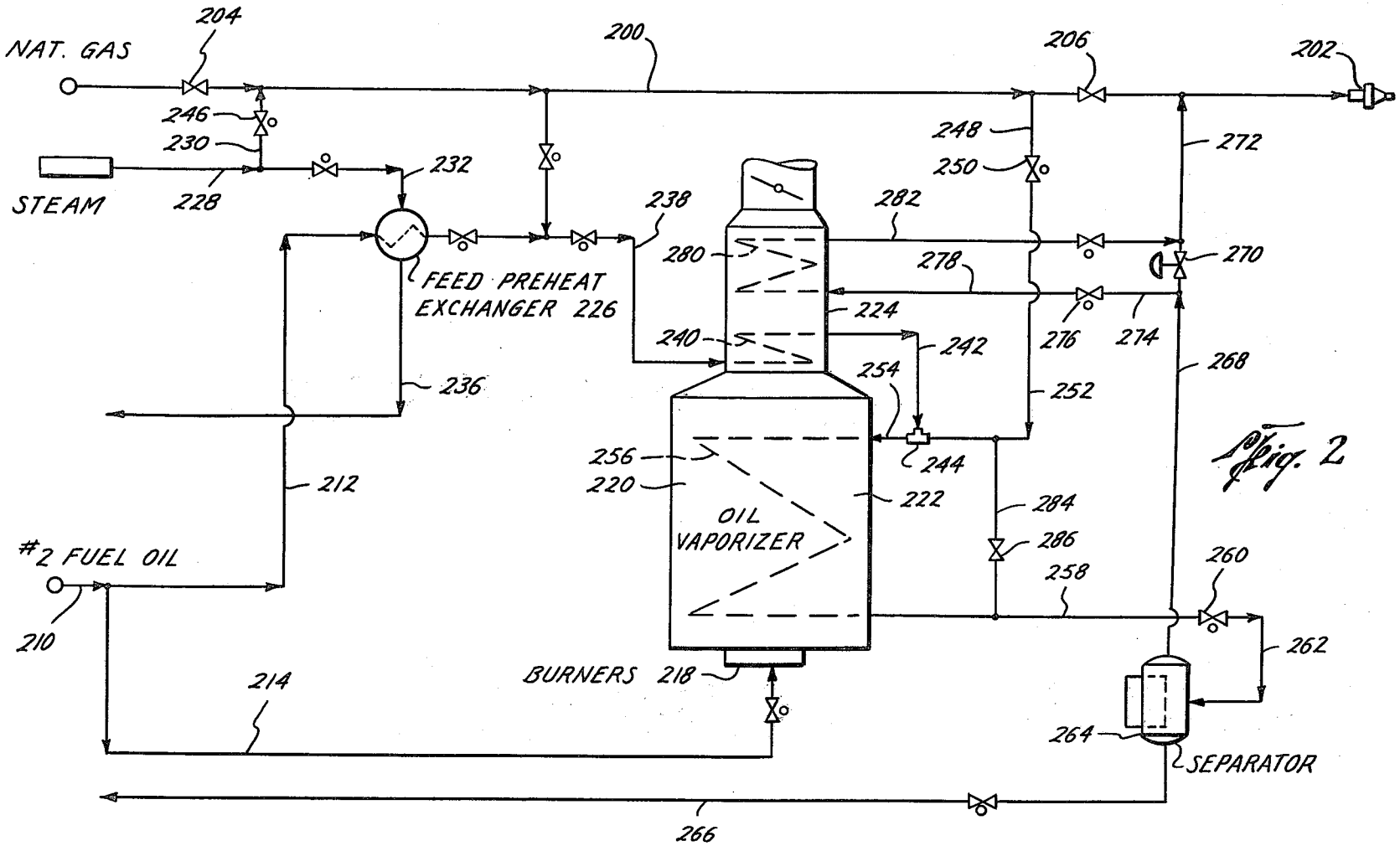
FIG. 2 is a schematic flowsheet of one preferred embodiment of this invention.

Referring to FIG. 2, a schematic diagram of one preferred embodiment of this invention is shown, without detailing all the common valves, fittings, controls and flow gauges known to those of ordinary skill in the art, wherein a fuel oil, such as Fuel Oil No. 2, is used in a system as an alternate fuel for burners normally designed for operation using natural gas. The apparatus and process described in FIG. 2 may be designed for erection on a portable platform but is adaptable to be used as a permanent fixture.

In this embodiment of the invention, the system is connected to a natural gas line 200 which transmitted the natural gas to the natural gas burner 202. The burner 202, which as mentioned before, represents either a single burner or a plurality of burners and may be in a single heater or a plurality of heaters which, of itself, is not part of this invention. Valves 204 and 206 may be placed in line 200 when the system is connected.

Fuel Oil enters the system through line 210 in the embodiment shown in FIG. 2 and branches into lines 212 and 214. A portion of the fuel oil travels through branch 214 and proceeds through valve 216, which is open in normal operation of the system of this embodiment, and continues to the fuel oil burners 218 of vaporizer 220. In the preferred embodiment of this invention, the vaporizer 220 has a radiant heating zone 222 and a convection heating zone 224 and is designed to have sufficient heating capacity to not only fully vaporize the fuel oil into a gaseous mixture suitable for the burner in which the gaseous mixture is to be used but also provide suitable duty for the radiant heating zone 222 and convection heating zone 224. The purpose of this will become apparent from subsequent discussions herein.

The fuel oil which is to be vaporized in the practice of this invention passes through line 212 to a feed preheat exchanger 226 to heat the fuel oil. In this embodiment, steam is introduced by line 228 into the system. Steam line 228 branches into lines 230 and 232 and valve 234 in line 232 is normally open to provide steam to the preheat exchanger 226 to heat the fuel oil and the steam exits the exchanger 226 by line 236. The fuel oil exits the preheat exchanger 226 by line 238 and thence to a coil 240 in the convection heating zone 224 where further heating occurs and the preferred apparatus for preheating the fuel oil is employed. The temperature of the fuel oil, such as No. 2 fuel oil, is preheated to a temperature below the dew point and exits the coil 240 by line 242 and thence to a mixing means 244 which may, as has been described previously, be a mixing vessel or nothing more than an ordinary pipeline "Tee." Steam is the carrier gas of choice for purposes of this discussion and passes through branch line 230 and valve 246, which is open in normal operation, and thence to line 200. Valves 204 and 206 are closed in normal operation. The steam travels through line 248 and valve 250, which is open in normal operation, into line 252 where the steam enters mixing means 244. The mixture of steam and liquid fuel oil then passes through line 254 to the vaporizer 220 where the mixture is not only vaporized into a gaseous mixture but preferably is superheated as the mixture passes through radiant coil 256 in the vaporizer 220. The heat for vaporizing the mixture is supplied by burning the fuel entering through line 214 and burned in burners 218 in the presence of air. The vaporizer 220 is designed to have sufficient heating capacity (duty) to not only fully vaporize the fuel oil into a gaseous mixture but preferably superheat the mixture, when for example No. 2 fuel oil is charged, in the radiant heating zone 222 but furthermore, the vaporizer 220 is designed to utilize the heat leaving the vaporizer 220 by having a convection zone 224. The purpose of this is partially apparent by the coil 240 which preheats the fuel oil but will become more apparent from subsequent discussions herein.

When No. 2 fuel oil is charged to the system of this embodiment of the invention, the conditions may be easily set to fully vaporize the fuel oil and steam mixture. Of course, when the heavier fuel oils are used in this system of this invention, there will likely be somewhat more unvaporized material but the temperature and pressure conditions of the carrier gas and fuel oil, the proportions thereof and heat (duty) in the vaporizer can be adjusted to optimize the conditions of the mixture. The gaseous mixture leaves the vaporizer 220 through line 258 and through valve 260, open during normal operation through line 262 and thence to separator 264 which can be any appropriate liquid/gas separation device, such as a drum separator.

The unvaporized fuel oil exits the separator 264 through line 266 where it can be recovered and used to provide fuel for other use at the plant site, including possibly to fire the vaporizer 220. The gaseous stream exits the separator 264 through line 268, through valve 270 and then through line 272 to line 200 where the gaseous mixture is transmitted to the natural gas burner 202. Depending on the distance the gaseous mixture must travel or other conditions, valve 270 may be adjusted to pass a portion or all of the vaporized mixture through line 274, valve 276, which may be open in normal operation, and line 278 to superheating coil 280 where the mixture is superheated sufficiently so that the mixture will be supplied to the burner(s) 202 as a gaseous mixture. The mixture is thus superheated in the coil 280 and exits through line 282 and line 272 to the burner 202. Alternately, the natural gas may be used as the carrier gas or as an aid in the start up of the system of the present invention.

As mentioned above, when No. 2 fuel oil is used there is no problem in vaporizing substantially all the fuel oil in vaporizer 220; however, when heavier fuel oils are used, the full vaporization may be obtained by adding steam through line 284 by opening valve 286. The steam addition, preferably superheated steam, completes vaporization externally of the vaporizer 220.

Figure 3:
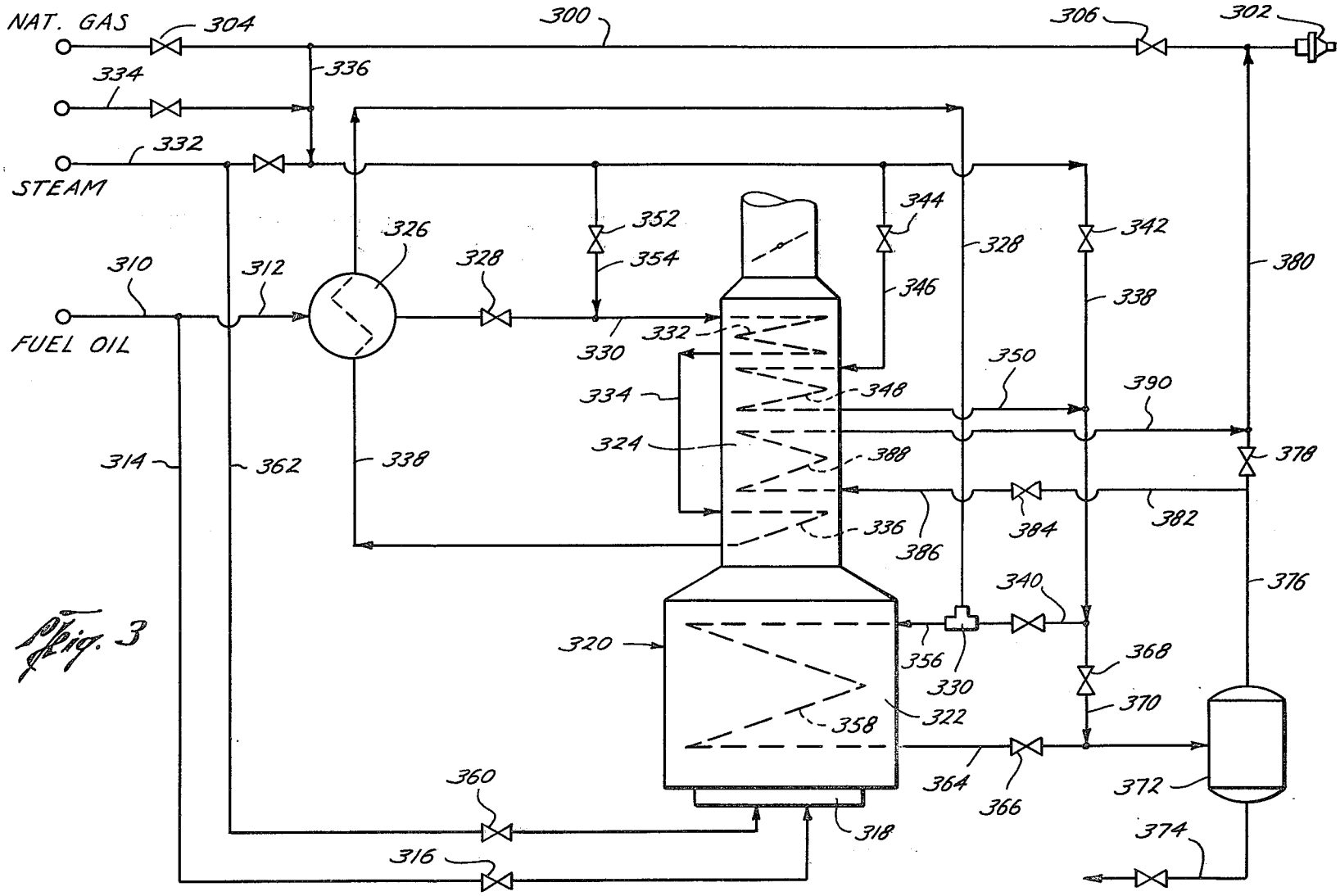
FIG. 3 is a schematic flowsheet showing another preferred embodiment of this invention.

Referring to FIG. 3, a schematic flowsheet of another preferred embodiment of this invention is shown. In this embodiment of the present invention, full utilization of the furnace employed in the system is made by recovery of the heat in the convection section used in the radiant section to vaporize the fuel oil. The greatest efficiency may accordingly be obtained by this embodiment of the invention.

In this embodiment of the invention, the system is corrected to a natural gas line 300 which transmitted the natural gas to the natural gas burner 302. Valves 304 and 306 may be placed in line 300 when the system is connected.

Fuel oil, for example No. 2 Fuel Oil, enters the system through line 310 in the embodiment of FIG. 3 and branches into lines 312 and 314. A portion of the fuel oil passes through line 314 and proceeds through valve 316, which is open in normal operation of the system of this invention, to the fuel oil burners 318 of vaporizer furnace 320. The furnace 320 has a radiant heating zone 322 and a convection heating zone 324, and the furnace is designed to have sufficient heating capacity to not only fully vaporize the fuel oil into a gaseous mixture in the radiant heating zone 322 suitable for the burner 302 but also to provide suitable duty for the heating done in the corrected heating zone 324 as will be set forth hereinafter.

The fuel oil which is to be vaporized in the practice of this embodiment passes through line 312 to a preheat exchanger 326. The heat is provided by heated fuel oil, as will be described. The fuel oil exits exchanger 326 and proceeds through valve 328 and line 330 into the uppermost section of the convection heating zone 324 in a coil 332. Additional heating of the fuel oil is obtained, if necessary, by passing the fuel oil through line 334 to a second coil 336 in the convection heating zone 324. The heated fuel oil exits the convection heating zone 324 through line 338 and passes in exchanger with the entering fuel oil in exchanger 326. The fuel oil is heated in the convection heating zone 324 to a temperature such that the entering fuel oil after passing through exchanger 326 enter coil 332 at a temperature of about 200° to 300° F. The temperature is maintained such that it is above the dew point of the flue gases passing through the convection heating zone. The heated fuel oil after passing through exchanger 326 passes through line 328 to a mixing means 330. The carrier gas, which may be steam, flue gas or natural gas is introduced into the system by lines 332, 334 or 336, respectively. Steam, the carrier gas of choice, passes through carrier line 338 and 340 to the mixing means 330. The steam is preferably superheated; however, if superheated steam is not available or not available at the desired conditions, the steam is diverted by closing valve 342 in line 338 and opening valve 344 in line 346 and passing the steam through coil 348 in the convection heating zone 324 of the furnace 320 to heat the steam to the desired conditions. The heated steam exits by line 350 and enters carrier lines 338 and 340 at the desired condition to be mixed with the fuel oil. In the system of this embodiment, steam may further be added to the fuel oil prior to its being heated in the convection heating zone 324, by opening valve 352 in line 354.

The mixture of steam and fuel oil then passes through line 356 to the radiant heating zone 322 of furnace 320 where the mixture is vaporized into a gaseous mixture in radiant coil 358. The heat for vaporizing the mixture is supplied by burning the fuel entering through line 314 and burned in burners 318 in the presence of air. Steam may also be supplied to the burners 318 by opening valve 360 in line 362. The heating capacity (duty) of the furnace 320 is designed not only to vaporize the fuel oil into a gaseous mixture but is designed to utilize the heat leaving the radiant heating zone 322 in the convection heating zone 324. The gaseous mixture which leaves the furnace 320 through line 364 and valve 366 is fully vaporized especially when No. 2 fuel oil is used. When No. 3 or No. 4 fuel oil is used, it may be desirable to add steam to the mixture in line 364 by opening valve 368 in line 370. A separator 372 is provided in the system which is provided so that any liquid may be separated and removed by line 374. The gaseous mixture exits the separator 372 through line 376, through valve 378 and then through line 380 to line 300 where the gas mixture is supplied to the gas burner(s) 302. Depending on the distance the gaseous mixture must travel or other conditions, valve 378 may be adjusted to pass a portion or all of the vaporized mixture through line 382, valve 384, and line 386 to superheating coil 388 where the gaseous mixture is superheated sufficiently so that the mixture will be supplied to the burner 302 as a gaseous mixture. The mixture is superheated in coil 388 and exits through line 390 and 380 to the burner 302. While steam has been used in the description of this embodiment, it is understood that another carrier gas may be employed.

The nature and objects of the present invention having been completely described and illustrated and the best mode thereof set forth, what we wish to claim as new and useful and secure by Letters Patent is:

1. A method for vaporizing a No. 2 Fuel Oil for use in a burner normally used for natural gas, which comprises the steps of:

(a) superheating steam to a temperature of from about 600° F. to about 900° F. at a pressure of from about 150 to about 100 psig;

(b) mixing the superheated steam with said fuel oil in proportions of from about 0.1 to about 1.0 pounds of steam per pound of fuel oil;

(c) heating the mixture to vaporize 80 to 98 wt.% of the fuel oil to produce a gaseous mixture at a temperature of from about 500° F. to about 900° F. and a pressure of from about 75 to about 130 psig; and (d) superheating the gaseous mixture, being substantially free of liquid fuel oil, to a temperature of from about 600° F. to about 800° F. at a pressure of from about 25 to about 45 psig whereby the gaseous mixture can be burned in a burner normally designed for burning natural gas.

2. The method of claim 1 wherein from about 0.3 to about 0.5 pounds of superheated steam is mixed per pound of No. 2 fuel oil.

3. A method according to claim 1 which includes mixing superheated steam to said gaseous mixture produced in step (c) prior to superheating.

4. Apparatus for vaporizing a normally liquid fuel oil such as Fuel Oil 2 through Fuel Oil No. 4 for use in a normally gas fired burner, which comprises:

means for supplying a liquid fuel oil;

a fuel oil feed exchanger for preheating said fuel oil;

means for supplying a carrier gas;

a vaporizer furnace having a radiant heating zone and a convective heating zone, a coil in said convective heating zone for further heating said fuel oil after passing through said exchanger, a second coil in said convective heating zone for heating said carrier gas, a heating coil in said radiant heating zone, and liquid fuel firing means for heating said vaporizer furnace;

means for mixing said heated carrier gas and said preheated fuel oil and introducing the mixture to said heating coil in said radiant heating zone for vaporizing said mixture to produce a gaseous mixture; and means for superheating the gaseous mixture whereby such gaseous mixture is suitable for use in a normally gas fired burner.

5. The apparatus of claim 4 wherein the heat supplied to said fuel oil feed exchanger is supplied by said carrier gas.

6. The apparatus of claim 4 wherein the heat supplied to said fuel oil feed exchanger is supplied by the preheated fuel oil after being heated in said convection heating zone.

7. Apparatus for vaporizing a normally liquid fuel oil such as Fuel Oil 2 through Fuel Oil No. 4 for use in a normally gas fired burner, which comprises:

means for supplying a liquid fuel oil;

a fuel oil feed exchanger for preheating said fuel oil;

means for supplying and heating a carrier gas;

a vaporizer furnace having a radiant heating zone and a convective heating zone, a coil in said convective heating zone for further heating said fuel oil after passing through said exchanger, a second coil in said convective heating zone, a heating coil in said radiant heating zone, and liquid fuel firing means for heating said vaporizer furnace; means for mixing said heated carrier gas and said preheated fuel oil and introducing the mixture to said heating coil in said radiant heating zone for vaporizing said mixture to produce a gaseous mixture; and means for introducing heated carrier gas to said gaseous mixture and superheating the gaseous mixture in said second coil whereby such gaseous mixture is suitable for use in a normally gas fired burner.

* * * * *